US005957449A

United States Patent [19]

Lüthi

[11] Patent Number: 5,957,449

[45] Date of Patent: Sep. 28, 1999

[54] PROCESS AND DEVICE FOR CONVEYING A STREAM OF PRINT SHOP PRODUCTS

[75] Inventor: Ernst Lüthi, Brittnau, Switzerland

[73] Assignee: Grapha-Holding AG, Hergiswil, Switzerland

[21] Appl. No.: 08/750,818

[22] PCT Filed: Apr. 3, 1996

[86] PCT No.: PCT/CH96/00120

§ 371 Date: Apr. 21, 1997

§ 102(e) Date: Apr. 21, 1997

[87] PCT Pub. No.: WO96/32351

PCT Pub. Date: Oct. 17, 1996

[30] Foreign Application Priority Data

Apr. 11, 1995 [CH] Switzerland ..... 1061/95

[51] Int. Cl.[6] ..... B65H 5/12

[52] U.S. Cl. ..... 271/204; 271/277; 271/69

[58] Field of Search ..... 271/69, 198, 204, 271/205, 277; 198/861.1, 465.4, 411

[56] References Cited

U.S. PATENT DOCUMENTS

| | | | |
|---|---|---|---|
| 4,320,894 | 3/1982 | Reist et al. | 271/69 |
| 4,443,094 | 4/1984 | Ricciardi | 271/69 |
| 4,604,851 | 8/1986 | Reist | 271/204 |
| 4,605,213 | 8/1986 | Hechler | 271/204 |
| 4,606,173 | 8/1986 | Meier | 271/204 |
| 4,896,874 | 1/1990 | Muller | 271/205 |
| 5,110,108 | 5/1992 | Muller | 271/69 |
| 5,169,139 | 12/1992 | Stauber et al. | 271/204 |
| 5,188,349 | 2/1993 | Honegger | 271/204 |
| 5,465,952 | 11/1995 | Eberle et al. | 271/204 |
| 5,669,604 | 9/1997 | Hansen | 271/204 |
| 5,727,783 | 3/1998 | Tassinari | 271/204 |

FOREIGN PATENT DOCUMENTS

| | | | |
|---|---|---|---|
| 2071274 | 12/1992 | Canada | 271/204 |
| 0300170 | 1/1989 | European Pat. Off. . | |
| 305671 | 3/1989 | European Pat. Off. | 271/204 |
| 2822060 | 12/1978 | Germany | 271/204 |
| 2922450 | 6/1995 | Germany . | |
| 344085 | 3/1960 | Switzerland . | |
| 92/02442 | 2/1992 | WIPO | 271/204 |

*Primary Examiner*—Dean Kramer
*Assistant Examiner*—Douglas Hess
*Attorney, Agent, or Firm*—Venable; Robert Kinberg; Catherine M. Voorhees

[57] ABSTRACT

The invention relates to a method and an apparatus for conveying a stream of printed products. The printed products are first conveyed along a first conveyor loop in a position in which they are oriented essentially tangentially to the conveying direction, and are transferred to a second conveyor loop. To facilitate the transfer, the printed products are brought into a transfer position, in which at least one region of each printed product is oriented at an angle to the tangential orientation.

11 Claims, 2 Drawing Sheets

PROCESS AND DEVICE FOR CONVEYING A STREAM OF PRINT SHOP PRODUCTS

BACKGROUND OF THE INVENTION

The invention relates to a method of conveying a stream of printed products in which, in a first section of an endlessly-circulating, first conveyor loop, the printed products are disposed individually one behind the other and oriented essentially tangentially to the conveying direction, and are transferred to a second endlessly-circulating conveyor loop. The invention further relates to an apparatus that can be used to execute such methods.

Methods of the above-described type are used, for example, to convey printed products that have been processed with a cutting apparatus. The cutting apparatus removes excess lateral edges of stapled, bound or unbound or unstapled printed products that have been assembled or collated. To this end, the printed products are usually supplied to the cutting apparatus along a fixed path of movement in a position oriented tangentially to their conveying direction, that is, in a position in which the planes of the individual sheets of the printed products extend parallel to the conveying direction; the printed products are then conveyed through the cutting apparatus and exit it. The printed products are subsequently taken up by a first conveying device circulating along a first conveyor loop, which usually maintains their orientation, and are transferred to a second conveying device that circulates along a second conveyor loop in order to be conveyed to a device, a so-called stacker, that forms bundles of printed products that are ready to be shipped.

The second conveying device typically has a plurality of grippers that pass a diversion point of the first conveyor loop along the second conveyor loop and serve to convey respectively one of the processed printed products. To take up the printed products conveyed along the first conveyor loop, the grippers are opened in the region of the diversion point and closed after taking a printed product at a transfer point in the region of the diversion point for transporting the printed products further along the second conveyor loop. The transfer is effected by the insertion of the processed printed products into the grippers opened at the transfer point.

To assure reliable operation of an apparatus for executing such methods, the grippers must pass the diversion point of the first conveyor loop along the second conveyor loop at precisely fixed intervals. It is also necessary for the circulating speed of the grippers and the conveying speed for the printed products conveyed along the first conveyor loop to be identical. The operating speed of such apparatuses is limited by the time to be made available for inserting the individual printed products at the transfer point.

SUMMARY OF THE INVENTION

In view of the above-described problems, it is an object of this invention to provide a method of the type mentioned at the outset, with which a high operating speed and assured operating reliability can be achieved simultaneously. A further object of the invention is to provide an apparatus with which such methods can be executed.

With respect to the method, this object is accomplished by at least one region of each printed product being oriented at an angle to the tangential orientation in a second section of the first conveyor loop that adjoins the first section, and the products being transferred to the second conveyor loop in this transfer position.

With the orientation of the individual printed products in the transfer position, the transfer to the second conveyor loop is not only possible at a single transfer point, but in the entire transfer region through which the regions of the printed products that are oriented at an angle to the tangential direction pass along the second section of the first conveyor loop. Consequently, the operating speed can be increased because an increase in the time available for the transfer is possible without a reduction in the conveying speed for the printed products along the first conveyor loop if the second conveying device serving to convey the individual printed products along the second conveyor loop extends parallel to at least a part of the transfer region. Further, reliable operation can be assured, even if the conveying speed along the second conveyor loop is not identical to the conveying speed along the first conveyor loop, because the second conveying device serving to convey the printed products along the second conveyor loop and the printed products brought into the transfer position can pass one another at different speeds over the course of the transfer region. As a result, the spacing between the individual printed products conveyed along the first conveyor loop can be changed simultaneously for further conveyance along the second conveyor loop.

The second conveying device used to execute the method of the invention preferably includes a plurality of grippers that are disposed one behind the other and can be switched between an open position and a closed position. In order to transfer the printed products to the second conveying device, the grippers pass a transfer region over the course of the second section of the first conveyor loop, through which region the regions of the printed products that are oriented at an angle to the tangential orientation pass, and at least some of the grippers are in the open position when they reach the transfer region for taking the printed products and, when they pass the transfer region, they are switched to the closed position for conveying the products along the second conveyor loop.

It is also possible for some of the grippers to reach the transfer region in the closed position, for example if they have already taken up a printed product.

To optimize operating capability in the execution of the method of the invention, the second conveying device is preferably controlled, as a function of the conveying speed for the printed products and the spacing between the regions of the printed products that are oriented at an angle to the tangential orientation in the transfer region, such that each printed product conveyed along the first conveyor loop is taken up by a gripper and conveyed along the second conveyor loop.

Over the course of the first conveyor loop, the printed products can be held and conveyed with two oppositely-located clips that lie against the product edges extending parallel to the conveying direction when the printed products are conveyed in the position oriented tangentially to the conveying direction. The printed products can be brought particularly simply into the transfer position by the rotation of the clips about an axis extending perpendicular to the conveying direction along the first conveyor loop and parallel to the printed product held thereon.

The clips serving to convey the printed products and bring them into the transfer position are usefully fixed to pulling means that circulate at least partly along the first conveyor loop with spacing that is predetermined by the dimensions of the printed products.

As can be inferred from the above description of the method of the invention, an apparatus that can be used to execute such methods is essentially characterized by the fact that, in a second section of the first conveyor loop that adjoins the first section, the printed products can be brought into a transfer position by an orienting device that can be placed against the printed products; in this position, at least one region of each product is oriented at an angle to the tangential orientation so that the printed products can be transferred to the second conveying device.

The orienting device usefully encompasses two clamping arrangements, in the form of clips or the like, that can travel along the first conveyor loop and be placed against lateral edges, preferably opposite lateral edges, of the printed products to be transferred.

The clips can advantageously be placed against lateral edges of the printed products that extend parallel to the conveying direction when the products are in the position tangential to the conveying direction. Over the course of the first section of the first conveyor loop, the clips can travel into a first rotational position to hold and convey the printed products in the position tangential to the conveying direction. Finally, the clips can be rotated into a second rotational position about an axis extending perpendicular to the conveying direction and parallel to the printed products held on the device in order to bring the printed products into the transfer position.

BRIEF DESCRIPTION OF THE DRAWING

The invention is described below with reference to the accompanying drawing figures, which expressly depict all details essential to the invention that are not discussed at length in the description, wherein.

DETAILED DESCRIPTION OF THE INVENTION

Figure 1A:
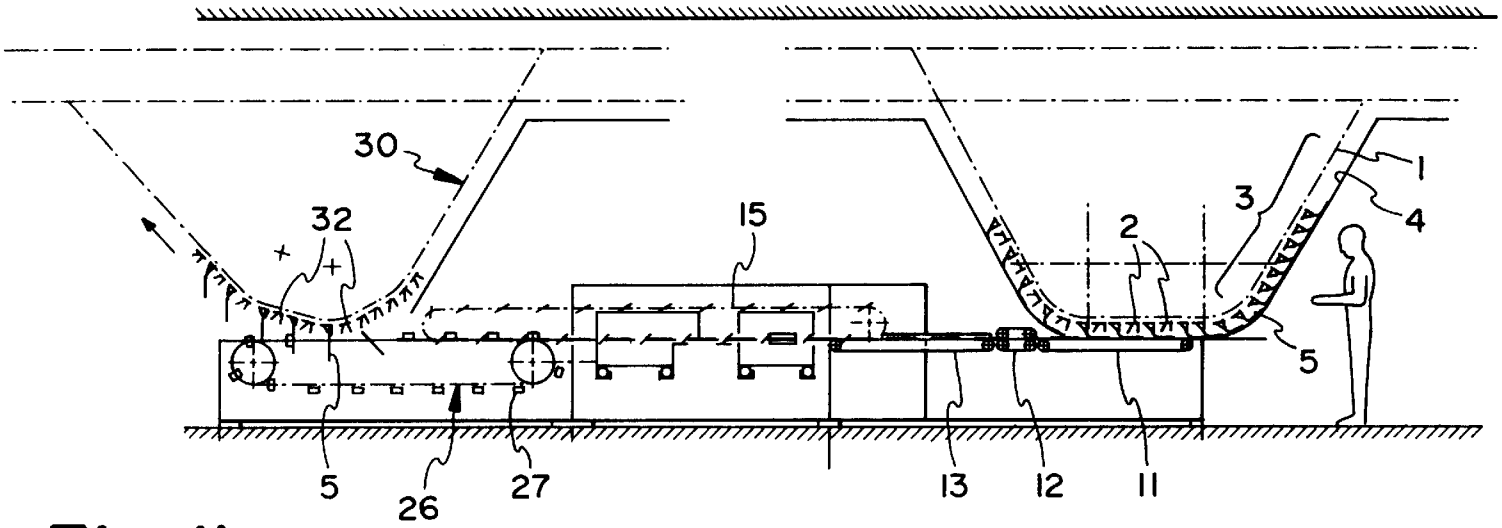
FIG. 1*a* is a side view of a cutting apparatus provided with an apparatus of the invention.

The apparatus shown in FIGS. 1*a* and *b* serves to process individual printed products along two parallel processing segments 10 and 20, as well as to transfer the printed products 5 that have been conveyed with conveying devices 16 or 26 disposed at the end of the processing segments 10 and 20 and first conveyed in a position tangential to their conveying direction to a second conveying device circulating endlessly along a second conveyor loop 30.

A cutting device 14 or 24 for removing excess lateral edges of the printed products is disposed along each processing segment 10 and 20 to process the individual printed products 5. A chain conveyor 1 having grippers 2 that circulate along a fixed path of movement and serve to supply a printed product 5 to a processing segment 10 or 20 is used to supply the printed products 5 to the cutting apparatuses 14 or 24. As can be seen from FIG. 1*a*, over the course of their path of movement, the grippers 2 that convey the printed products 5 are lowered along a path segment 3 to deposit the printed products 5 onto a conveyor belt 11 disposed at the beginning of the processing segment 10. During the lowering of the grippers, the printed products 5 held by their fold by the individual grippers 2 are guided by a guide 4 such that their pre-fold follows the associated gripper 2. This assures the formation of a regular stream of printed products on the conveyor belt 11.

As can further be inferred from FIG. 1*a*, only every other printed product held by the grippers 2 is deposited onto the conveyor belt 11 of the first processing segment 10. The other printed products 5 are lifted again with the grippers 2 along the path of movement 1, and conveyed further to be deposited onto a conveyor belt 21 disposed at the beginning of the processing segment 20. The printed products are deposited onto the conveyor belt 21 in a manner similar to the above-described deposit onto the conveyor belt 11.

The printed products first deposited onto the conveyor belt 11 or 21 are taken up by a belt press 12 or 22 over the course of the processing segments 10 and 20, and are transferred from there to a belt conveyor 13 or 23. The belt presses 12 or 22 effect a positioning of the printed products along the processing segments 10 and 20 that assures the operating reliability of the cutting apparatuses 14 or 24.

Figure 1B:
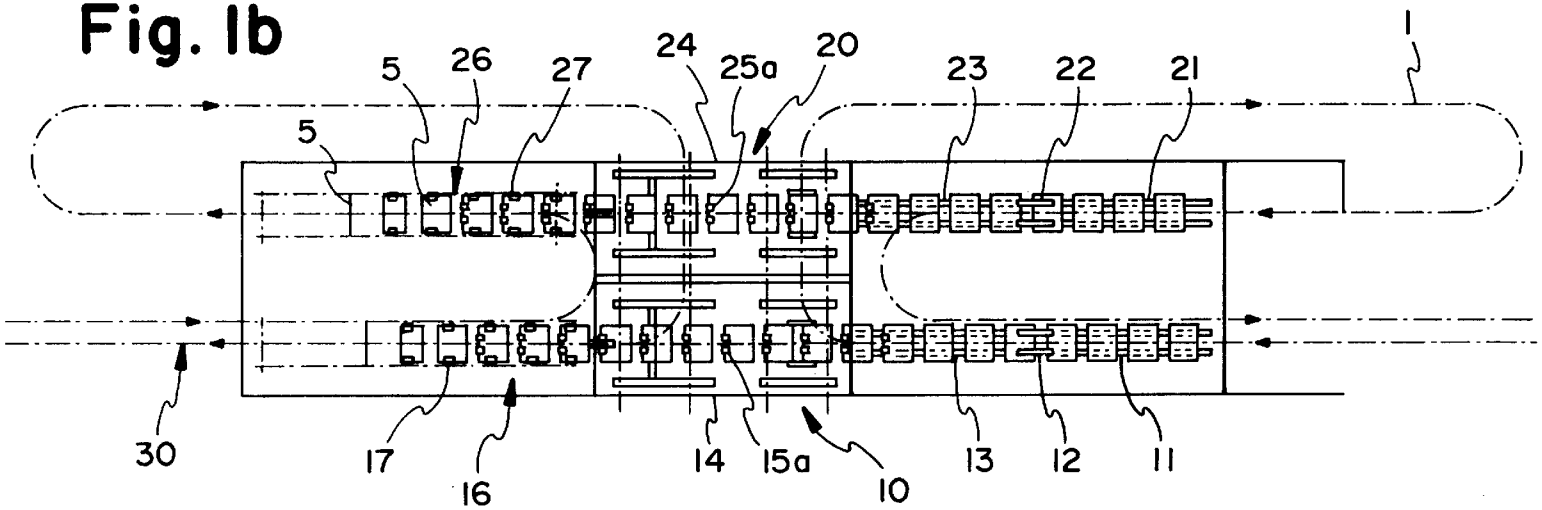
FIG. 1*b* is a plan view of the apparatus in FIG. 1*a*, and FIGS. 2*a* and *b* are enlarged representations of transfer regions of the apparatus in FIGS. 1*a* and *b*.

As can be inferred from FIG. 1*b*, the belt conveyors 13 and 23 are configured as two parallel conveyor belts circulating endlessly with spacing from one another.

Therefore, the individual printed products can be grasped by their fold between these conveyor belts with grippers 15*a* or 25*a* fixed to an endlessly-circulating conveyor chain 15, and guided through the cutting apparatuses 14 or 24. To simplify the representation, FIG. 1*a* only shows the conveyor chain 15 associated with the conveyor segment 10.

Following processing with the cutting apparatuses 14 or 24, the printed products, which up to this point have been held by their fold, are transferred to first sections 18 or 28 of conveying devices 16 or 26. These conveying devices 16 or 26 disposed at the end of the processing segments 10 and 20 have endlessly-circulating clips 17 or 27 that are located opposite one another with space between them. The individual, oppositely-located clips 17 or 27 are disposed such that the individual printed products that have been processed with the cutting apparatuses 14 or 24 can be grasped by their lateral edges extending perpendicular to the fold, and conveyed.

Figure 2A:
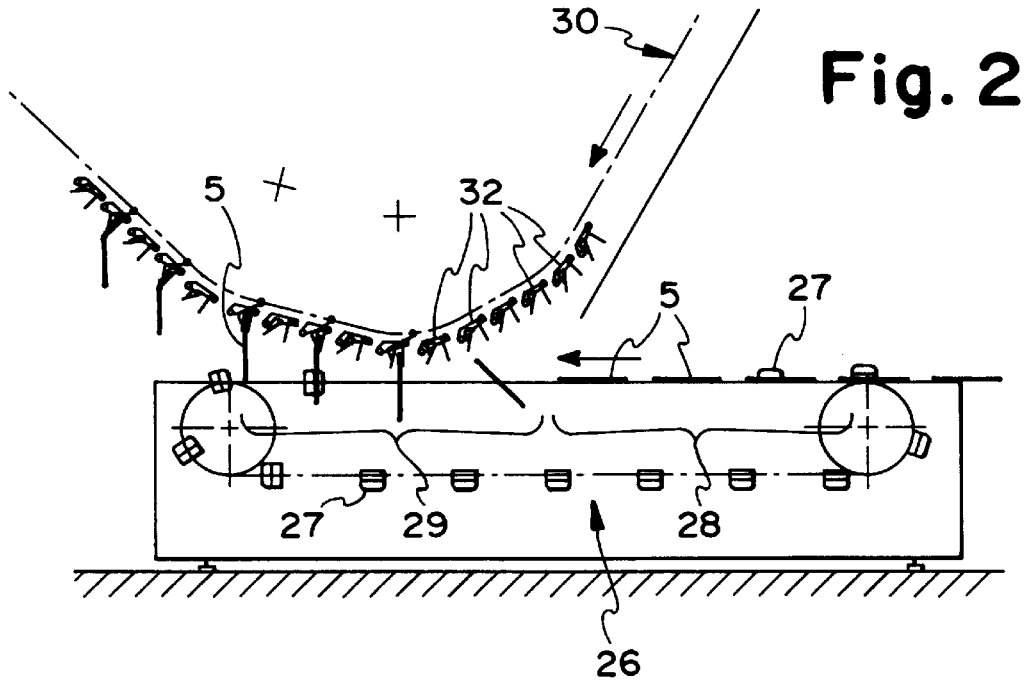

As can be inferred particularly clearly from FIGS. 2*a* and *b*, the individual clips 17 or 27 can be rotated, with the printed products conveyed between them, about an axis extending perpendicular to the conveying direction and parallel to the printed products in a second section or transfer region 19 or 29 of the conveyor loops through which the conveying devices 16 or 26 pass. Consequently, the printed products conveyed by the clips 17 or 27 are individually oriented at an angle to the conveying direction.

In this transfer position, the printed products are transferred to grippers 32 conveyed along a second conveyor loop 30. To transfer the printed products, the grippers 32 are lowered over the course of the second conveyor loop into a position in which they can grasp the printed products held by the clips 17 or 27. As can be inferred from FIG. 2a, all grippers 32 conveyed along the conveyor loop 30 are in the open position when they reach the transfer region 29 formed by the second section of the conveyor loop through which the conveyor device 26 passes, and a printed product is transferred to every other open gripper, after which the relevant grippers are switched to the closed position to convey the transferred printed products along the second conveyor loop 30.

Figure 2B:
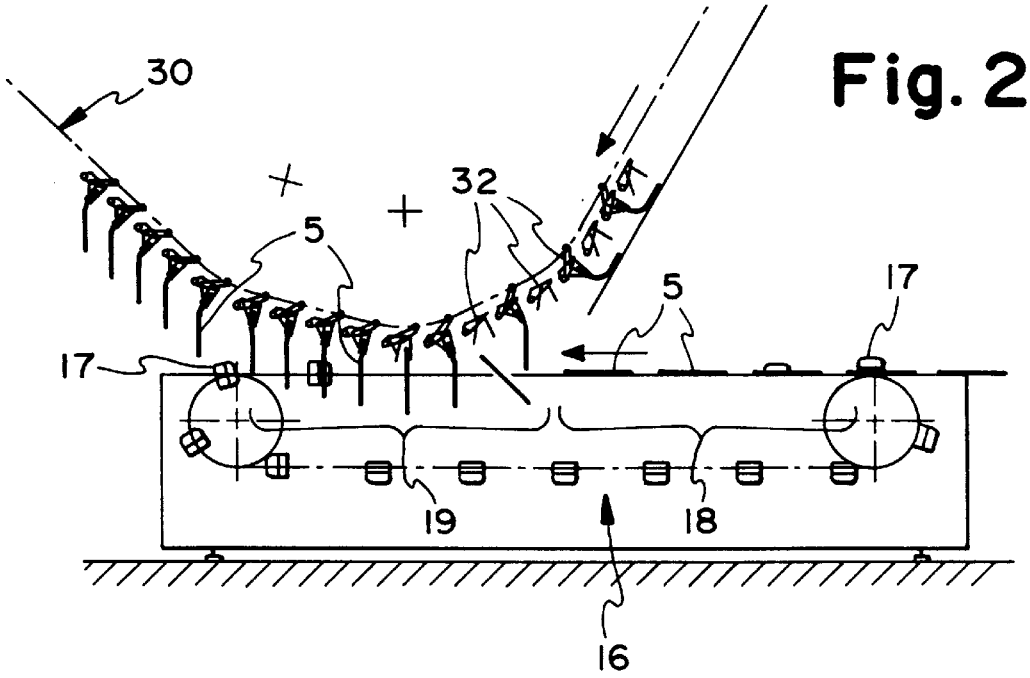

Subsequently, all grippers are lifted again over the course of the conveyor loop 30, and are not lowered again until they take up the printed products conveyed with the conveying device 16 in the transfer region 19 (FIG. 2*b*). Whereas the grippers that have already taken up a printed product in the transfer region 29 reach the transfer region 19 in the closed position, the grippers 32 between them are in the open position when they reach this transfer region to take up the printed products processed along the processing segment 10. Over the course of the transfer region 19, these grippers 32 are also switched into the closed position to convey the printed products transferred there along the second conveyor loop (30).

As a result, a stream of printed products is obtained following the transfer region 19 in which the individual printed products are spaced from one another by a distance corresponding to one-half the spacing of the printed products conveyed along the processing segments 10 and 20.

As can be inferred from the above description, the apparatus illustrated in FIGS. 1*a* and *b* and 2*a* and *b* encompasses two conveying devices 16 and 26, which circulate along endlessly-circulating conveyor loops and with which a common conveying device is associated that circulates along a second conveyor loop 30. Each of the conveying devices 16 and 26 forms a first conveying device from which the printed products that it has conveyed are transferred to the second conveying device in the form of the grippers 32 circulating along the second endlessly-circulating conveyor loop 30. Consequently, with the use of the method of the invention, two partial streams of printed products are combined to form a single stream. Similarly, with the use of the method of the invention, it is possible to combine a plurality of partial streams of printed products to form a single stream.

The invention is not limited to the above-described example. Rather, it is also conceivable to use the clips to orient only regions of the printed products at an angle to the tangential orientation. It is also conceivable to orient the printed products over the course of the second section of the first conveyor loop using only one clip.

I claim:

1. A method of conveying a stream of printed products comprising the steps of:

orienting products one behind the other individually in a first section of an endlessly-circulating, first conveyor loop, said individual products being aligned essentially tangentially to a conveying direction of the first endlessly-circulating conveyor loop;

transferring the individual products to a second endlessly-circulating conveyor loop wherein at least one region of each printed product is oriented at an angle to the tangential orientation in a second section of the first conveyor loop adjoining the first section during the transferring step;

conveying the individual printed products along the second conveyor loop with a second conveying device that includes a plurality of grippers that are disposed one behind the other and can be switched between an open position and a closed position and, in the transferring step, the grippers pass a transfer region through which regions of the printed products oriented at an angle to the tangential orientation pass over the second section of the first conveyor loop, and at least a few of the grippers are in the open position when they reach the transfer region in order to take up the printed products, and are switched into the closed position as they pass the transfer region in order to convey the printed products along the second conveyor; and controlling the second conveyor device as a function of the conveying speed for the individual printed products and the spacing between regions of the printed products that are oriented at an angle to the tangential orientation in the transfer region, such that each printed product is taken up by a gripper and conveyed along the second conveyor loop.

2. The method according to claim 1, wherein a few of the grippers are in the closed position when they reach the transfer region.

3. The method according to claim 1, wherein over the course of the first conveyor loop, the printed products can be held and conveyed with two clips that lie against opposite edges of the printed products extending parallel to the conveying direction when the printed products are conveyed in the position oriented tangentially to the conveying direction.

4. The method according to claim 3, wherein the clips are rotated about an axis extending perpendicular to the conveying direction along the second section of the first conveyor loop and parallel to the printed products held thereon in order to bring the printed products into the transfer position.

5. The method according to claim 1, wherein in the transferring step, at least a front edge of each printed product is set upright at an angle to the tangential orientation in the second section that adjoins the first section.

6. A method of conveying a stream of printed products comprising the steps of:

orienting products one behind the other individually in a first section of an endlessly-circulating, first conveyor loop, said individual products being aligned essentially tangentially to a conveying direction of the first endlessly-circulating conveyor loop; and transferring the individual products to a second endlessly-circulating conveyor loop wherein at least one region of each printed product is oriented at an angle to the tangential orientation in a second section of the first conveyor loop adjoining the first section during the transferring step.

7. An apparatus for conveying a stream of printed products comprising a first conveying device that can be operated to convey the printed products, in a position in which they are oriented individually and essentially tangentially to the conveying direction, along a first section of an endlessly-circulating, first conveyor loop, and a second conveying device that can be operated to convey the printed products conveyed along the first convey or loop, wherein an orienting device, is can be placed against one of the individual printed products, the printed products are brought into a transfer position, in which at least one region of the printed products is oriented at an angle to the tangential orientation so that the printed products can be transferred to the second conveying device in a second section of the first conveyor loop that adjoins the first section.

8. The apparatus according to claim 7, wherein the orienting device that is be placed against the individual printed products includes a clamping arrangement that can travel along the first conveyor loop and be placed against lateral edges of the printed products to be transferred, each clamping arrangement including two clips that can be placed against opposite lateral edges of the printed products to be transferred.

9. The apparatus according to claim 8, wherein the clips can be placed against lateral edges of the printed products that extend parallel to the conveying direction when the products are in the position tangential to the conveying direction, and, over the course of the first section of the first conveyor loop, the clips can travel into a first rotational position to hold and convey the printed products in the position tangential to the conveying direction, and that the clips can be rotated into a second rotational position about an axis extending perpendicular to the conveying direction and parallel to the printed products held on the device in order to bring the printed products into the transfer position in the second section of the first conveyor loop.

10. The apparatus according to claim 9, wherein the clips are fixed to, and therefore can travel with, pulling means that circulate at least partly along the first conveyor loop with spacing that is predetermined by dimensions of the printed products.

11. The apparatus according to claim 7, wherein the second conveying device includes a plurality of grippers that can travel along the second conveyor loop, the grippers are disposed one behind the other, and can be switched between an open position and a closed position; and over the course of the second conveyor loop, the grippers pass a transfer region through which region the regions of the printed products that are oriented at an angle to the tangential orientation pass over the second section of the first conveyor loop, and that the second conveying device is controlled, as a function of the conveying speed for the printed products and the spacing between the individual regions of the printed products that are oriented at an angle to the tangential orientation in the transfer region, such that at least some of the grippers are in the open position when they reach the transfer region for taking up the printed products and, when they pass the transfer region, they are switched to the closed position for conveying the products along the second conveyor loop.

* * * * *